US011976907B2

(12) United States Patent
Allison

(10) Patent No.: US 11,976,907 B2
(45) **Date of Patent: *May 7, 2024**

(54) PROJECTILE WITH PYROTECHNICALLY TIMED RELEASE OF A SECONDARY PAYLOAD

(71) Applicant: The United States of America, as represented by the Secretary of the Navy, Crane, IN (US)

(72) Inventor: Lucas Allison, Bloomington, IN (US)

(73) Assignee: The United States of America, Represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/083,915

(22) Filed: Dec. 19, 2022

(65) Prior Publication Data

US 2023/0332874 A1 Oct. 19, 2023

Related U.S. Application Data

(63) Continuation of application No. 16/713,550, filed on Dec. 13, 2019, now Pat. No. 11,561,075.

(60) Provisional application No. 62/779,234, filed on Dec. 13, 2018.

(51) Int. Cl.

| | |
|---|---|
| ***F42B 12/62*** | (2006.01) |
| ***F42B 12/32*** | (2006.01) |
| ***F42B 12/58*** | (2006.01) |
| ***F42C 9/10*** | (2006.01) |
| ***F42C 19/08*** | (2006.01) |

(52) U.S. Cl.
CPC ..... *F42B 12/62* (2013.01); *F42B 12/32* (2013.01); *F42B 12/58* (2013.01); *F42C 9/10* (2013.01); *F42C 19/0838* (2013.01)

(58) Field of Classification Search
CPC ..... F42B 12/32; F42B 12/48; F42B 12/56; F42B 12/58; F42B 12/60; F42B 12/62; F42B 12/64; F42C 9/10; F42C 19/08; F42C 19/0838
USPC ..... 102/393, 489
See application file for complete search history.

(56) References Cited

U.S. PATENT DOCUMENTS 174,325 A * 2/1876 Tyler ..... F42B 12/62 102/489
1,140,041 A * 5/1915 Karlik ..... F42B 12/62 102/489

(Continued)

*Primary Examiner* — James S Bergin
(74) *Attorney, Agent, or Firm* — Naval Surface Warfare Center, Crane Division; Christopher Feigenbutz

(57) ABSTRACT

The present invention relates to a firearm projectile capable of releasing a secondary payload mid-flight through a pyrotechnic timing mechanism. Once the firearm is fired, the powder in the casing pushes out the projectile as a typical round. In addition, the powder ignites the delay column. The formulation and amount of delay pyrotechnics determines the delay time. When the delay column is burned, the final portion ignites an expelling charge. The expelling charge builds pressure in the projectile casing and separates the base plug from the main projectile housing. The expelling assembly pushes out the secondary payload out the rear of the projectile. Although the payload exits the rear of the projectile at minimum velocity, the net velocity of the payload is still in the forward direction.

15 Claims, 5 Drawing Sheets

(56) References Cited

U.S. PATENT DOCUMENTS

| | | | | | |
|---|---|---|---|---|---|
| 1,272,984 | A * | 7/1918 | Mutro | F42B 12/58 | 102/494 |
| 3,677,182 | A * | 7/1972 | Peterson | F42B 12/62 | 102/505 |
| 3,724,378 | A * | 4/1973 | Knight | F42B 12/64 | 102/448 |
| 3,954,060 | A * | 5/1976 | Haag | F42B 12/64 | 102/494 |
| 3,956,990 | A * | 5/1976 | Rowe | F42B 12/64 | 102/494 |
| 4,119,037 | A * | 10/1978 | Romer | F42B 12/62 | 102/489 |
| 5,076,171 | A * | 12/1991 | Altenau | F42B 8/22 | 102/357 |
| 5,287,810 | A * | 2/1994 | Aumasson | F42B 12/62 | 102/357 |
| 5,317,975 | A * | 6/1994 | Sauvestre | F42B 12/62 | 102/357 |
| 5,353,711 | A * | 10/1994 | Botticelli | F42B 17/00 | 102/490 |
| 9,423,226 | B2 * | 8/2016 | Cillaut | F42B 12/62 | |
| 9,778,004 | B2 * | 10/2017 | Rumfitt | F42B 12/64 | |
| 11,561,075 | B2 * | 1/2023 | Allison | F42B 12/58 | |

* cited by examiner

PROJECTILE WITH PYROTECHNICALLY TIMED RELEASE OF A SECONDARY PAYLOAD

STATEMENT REGARDING FEDERALLY SPONSORED RESEARCH OR DEVELOPMENT

This application is a continuation of U.S. patent application Ser. No. 16/713,550, filed Dec. 13, 2019 entitled "PROJECTILE WITH PYROTECHNICALLY TIMED RELEASE OF A SECONDARY PAYLOAD," which claims priority to U.S. Provisional Patent Application Ser. No. 62/779,234 filed Dec. 13, 2018 entitled "PROJECTILE WITH PYROTECHNICALLY TIMED RELEASE OF SECONDARY PROJECTILES" the disclosure of which is expressly incorporated by reference herein. Licensing and technical inquiries may be directed to the Technology Transfer Office, Naval Surface Warfare Center Crane, email: Crane_T2@navy.mil.

FIELD OF THE INVENTION

The present invention relates to a firearm projectile capable of releasing secondary projectiles mid-flight through a pyrotechnic timing mechanism.

BACKGROUND AND SUMMARY OF THE INVENTION

The present invention relates to a firearm projectile using pyrotechnic compositions to time the release of secondary projectiles mid-flight with a spread effect to maximize both effective range and likelihood of hitting a moving target. Current rounds that have multiple projectiles have limited range due to drag acting upon the individual particles and each projectile lacking aerodynamic shape. Single projectiles have long range but low probability of hitting the target if the target moves during the projectile's travel time or if there the firearm operator does not aim accurately. Existing projectiles using electronic timing fuzes are inadequate for most types of conventional firearm projectiles because the electronics have large space requirements, add extra weight to the projectile, and changes the center of balance, which can reduce the effective range of the projectiles.

According to an illustrative embodiment of the present disclosure, a projectile with a projectile body coupled to a projectile base. Once the round is fired, the powder in the casing pushes out the projectile as a typical round. In addition, the powder ignites the delay column. The formulation and amount of delay pyrotechnics determines the delay time. When the delay column is burned, the final portion ignites an expelling charge. The expelling charge builds pressure in the projectile body and separates the projectile base from the main projectile housing. The expelling assembly pushes out the payload out the rear of the projectile. Although the payload exits the rear of the projectile at minimum velocity, the net velocity of the payload is still in the forward direction, similar to firing a shotgun down range.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
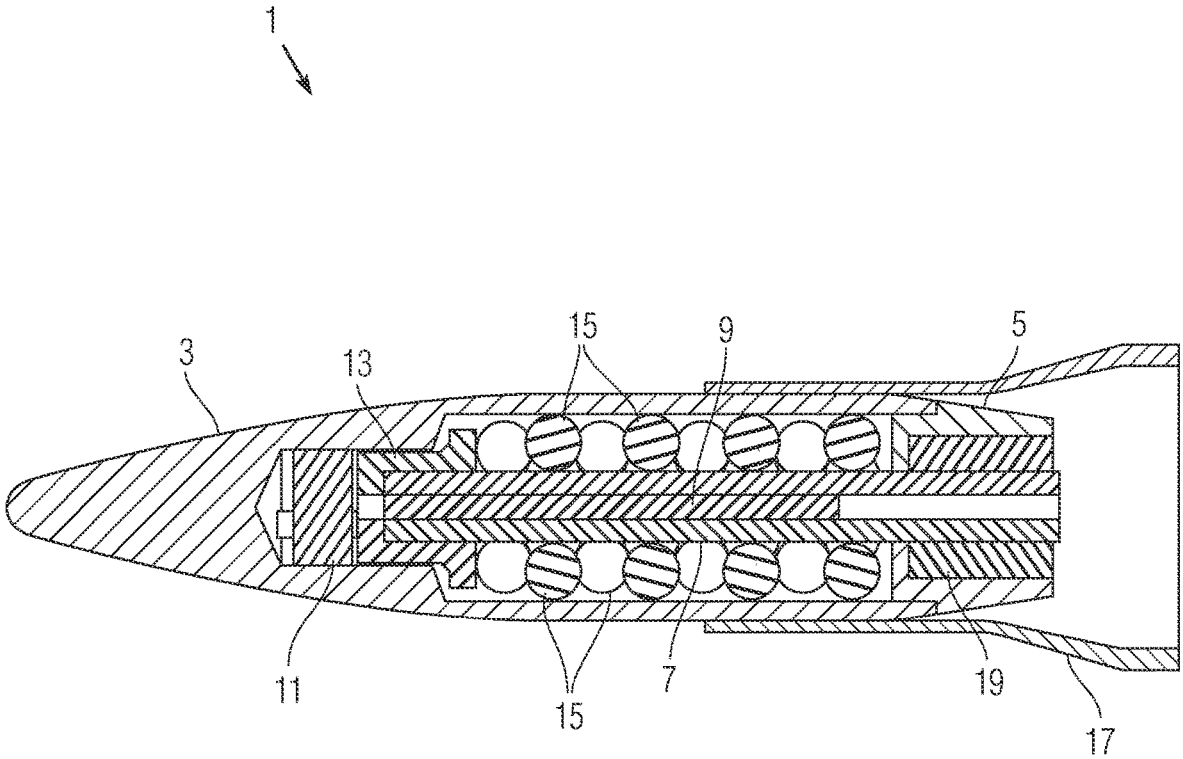
FIG. 1 shows an exemplary pyrotechnically timed projectile.

FIG. 1 shows an exemplary pyrotechnically timed projectile 1. Projectile body 3 houses delay column section 7 (e.g., a tube), delay composition 9, expelling charge 11, expelling assembly 13, and secondary payload 15. Projectile 1 is coupled to case 17 such that a first end of delay column section 7 is near powder inside case 17. Projectile body 3 is coupled to projectile base 5 with an interference fit. Once the cartridge (i.e., the combined projectile and case) is fired, powder in the case 17 pushes out the projectile 1 like a conventional round and ignites the delay composition 9. The delay composition 9 burns up the length of the delay column section 7. The formulation and amount of the pyrotechnic composition determines a delay time between initial firing (i.e., when the cartridge is fired) and secondary firing (i.e., when the expelling charge ignites). The delay composition 9 touches or is very close to an expelling charge 11 at a second end of the delay column section 7. When the burning of the delay composition 9 reaches a final portion of the delay composition, the delay composition ignites the expelling charge 11. The ignition of the expelling charge 11 builds pressure within the projectile body 3 that separates the projectile base 5 from the projectile body 3.

The pressure created by the expelling charge 11 creates a force on expelling assembly 13, causing expelling assembly 13 to move towards the first end of the delay column section 7 and push the secondary payload 15 (e.g., spheres, flechettes, string/nets, RFID tags, etc.) out the rear of the projectile body 3. Although the secondary payload 15 exits the rear (relative to projectile 1 flight path) of the projectile body 3 at minimum velocity, the net velocity of the secondary payload 15 is still in the forward direction relative to the firearm user. As the secondary payload 15 exits the projectile body, the secondary payload spreads out. Because the secondary payload 15 travels within the projectile body 3 prior to exiting the projectile body, the secondary payload receive the aerodynamic advantages of projectile body 3 during the delay time, allowing the secondary particles to travel further before being subjected to drag upon each individual projectile of secondary payload 15. Secondary payload 15 can be selected based on the desired effect. In at least some embodiments, a tracer composition 19 can be placed within projectile base 5 such igniting the powder in case 17 also ignites the tracer composition. The properties of secondary payload 15 can be selected (e.g., choice of materials, addition of filler, etc.) to modify the flight properties (e.g., stability, aerodynamics, etc.) of projectile 1 and secondary payload 15.

Figure 2:
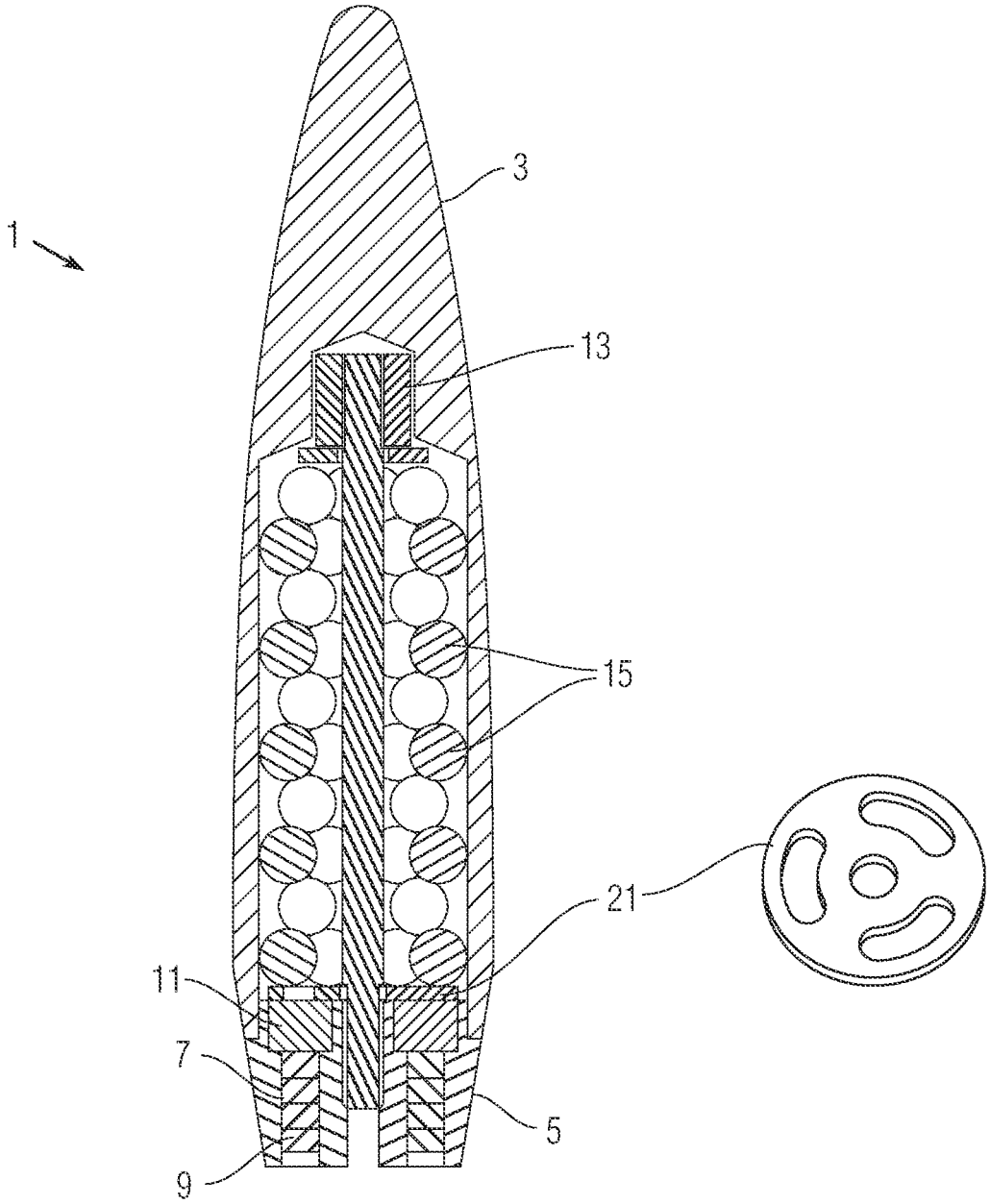
FIG. 2 shows an exemplary pyrotechnically timed projectile.

FIG. 2 shows an exemplary pyrotechnically timed projectile 1. Delay column section 7 is formed within projectile base 5 and at least one expelling charge 11 can be inserted into projectile base 5. A delay composition 9 is in contact with each expelling charge 11 at a forward end of each delay column section 7. When the burning of the delay composition 9 reaches a final portion of the delay composition, the delay composition ignites the corresponding expelling charge 11. The ignition of the at least one expelling charge 11 builds pressure within the projectile body 3 which separates the projectile base 5 from the projectile body 3. Using two expelling charges 11 adds redundancy to ensure separation. The shorter delay composition height (relative to the embodiment shown in FIG. 1) allows a wider variety of delay compositions to be used because slower burning compositions can still reach expelling charges 11 within a small timeframe (and thus shorter flight distances). Expelling assembly 13 is coupled to projectile base 5 such that projectile base 5 pulls expelling assembly 13 when projectile body 3 and projectile base 5 separate, causing expelling assembly 13 to push the secondary payload 15 (e.g., spheres, flechettes, string/nets, RFID tags, etc.) out the rear of the projectile body 3. A plate 21 can be disposed between secondary payload 15 and the at least one expelling charge 11 to prevent the payload from contacting and damaging the pyrotechnics. Plate 21 should be formed with an aperture so that gas from expelling charge 11 can still enter projectile body 3. Plate 21 should also be formed with a central aperture so that expelling assembly 13 can pass through plate 21.

Figure 3:
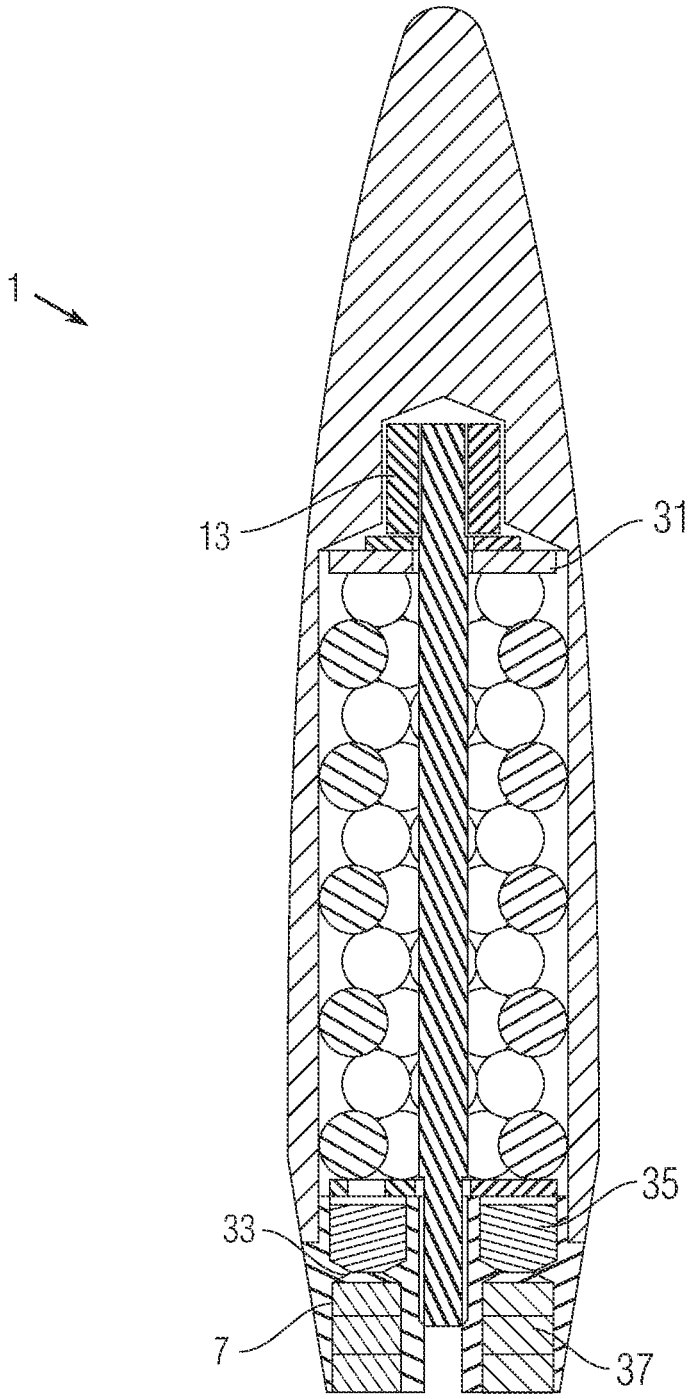
FIG. 3 shows an exemplary pyrotechnically timed projectile.

FIG. 3 shows an exemplary pyrotechnically timed projectile 1. A pad 31 can be placed between the top portion of expelling assembly 13 and the secondary payload. Pad 31 can be made of a flexible material so that when a secondary payload is inserted into the projectile body, the payload will push into pad 31 to create a tighter and more compact fit for maximum payload density. This can also help prevent the payload from shifting during flight. The delay column section 7 can be formed with an orifice restriction 33 to ensure that expelling charge gas enters the projectile body instead of leaving through the delay column section 7. If only one expelling charge is used, an inert placeholder 35 can be inserted into the projectile base. The corresponding delay composition can then be replaced with a tracer composition 37.

Figure 4:
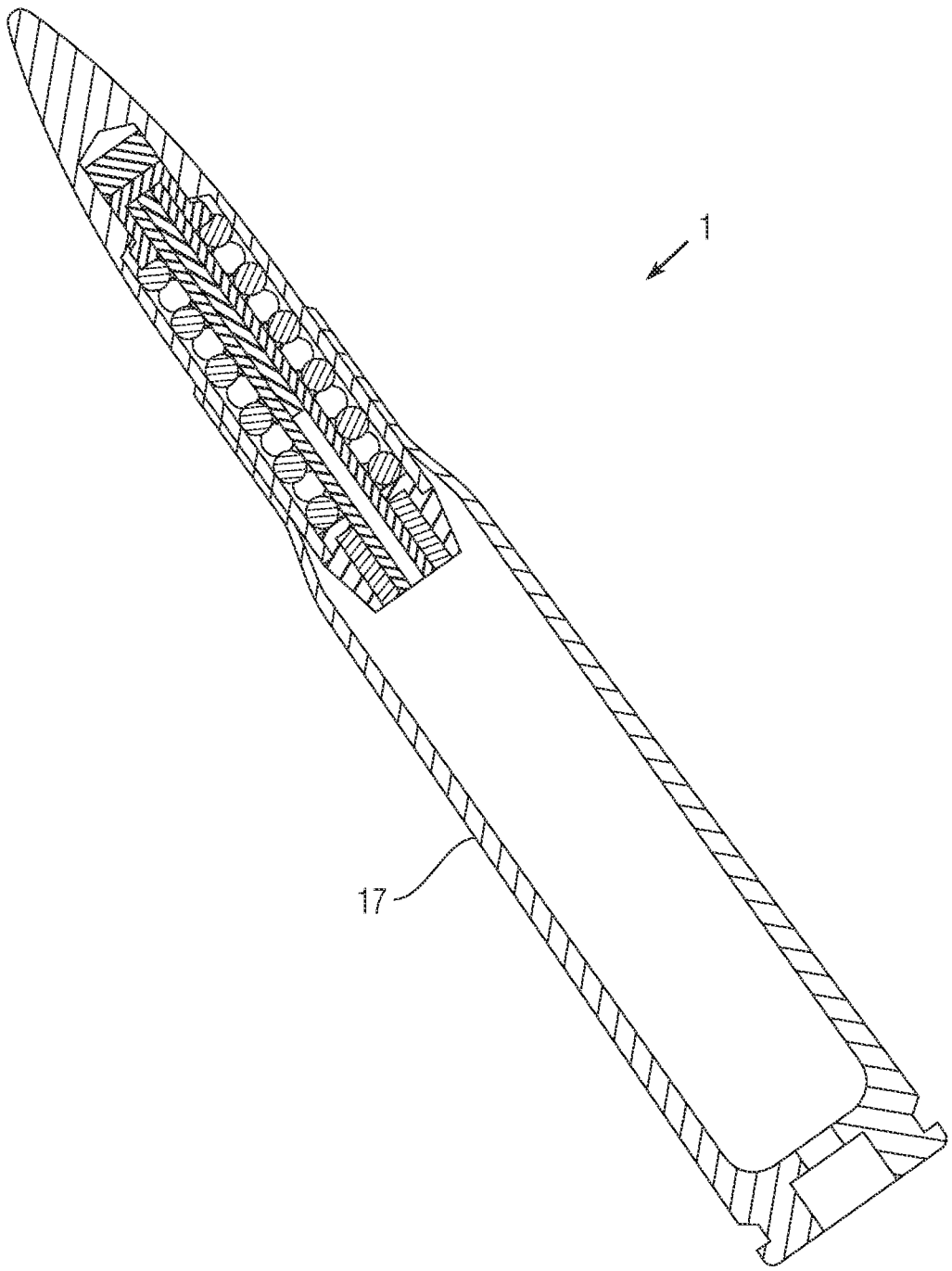
FIG. 4 shows a cartridge with an exemplary pyrotechnically timed projectile.

FIG. 4 shows an exemplary cartridge with a pyrotechnically timed projectile 1. Projectile 1 is coupled to a case 17. Case 17 can be filled with powder. A plurality of projectiles 1 can be loaded into a magazine or ammunition belt. By adjusting the delay composition of adjacent projectiles, the delay time between firing and payload release can be configured to increase the likelihood of hitting a moving target. For example, if a target is moving towards a firearm user, a sequence of decreasing delay times will make it easier to hit the target. Likewise, a sequence of increasing delay times will make it easier to hit a target moving away from a firearm user.

Figure 5:
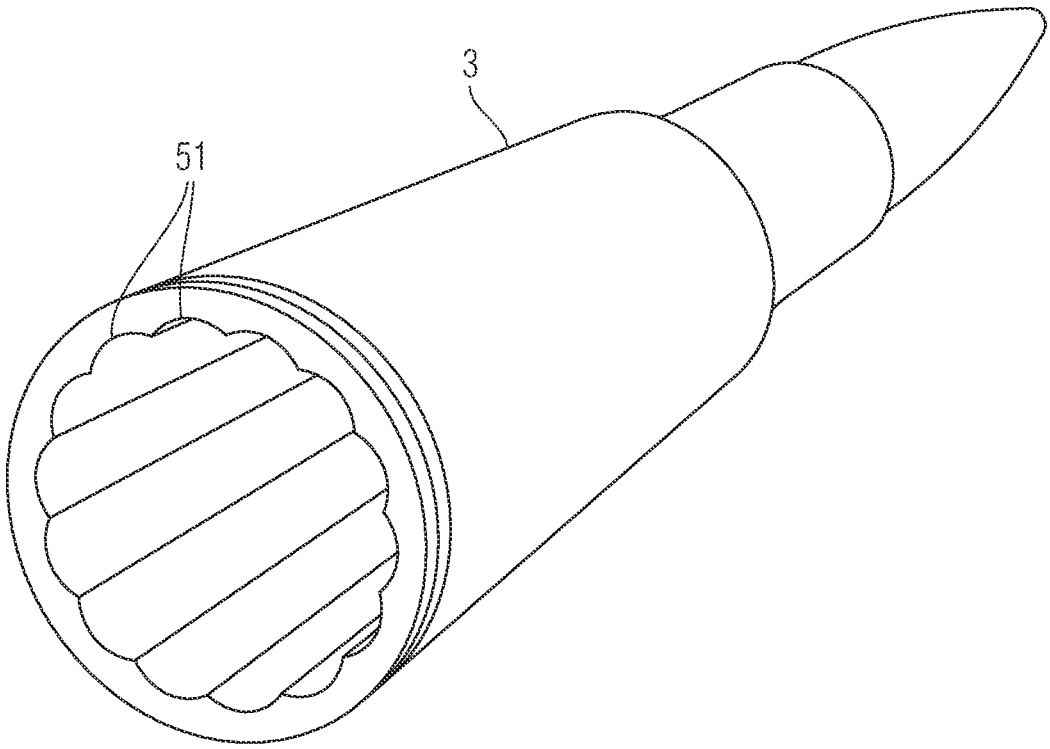
FIG. 5 shows an exemplary projectile body with a plurality of slots.

FIG. 5 shows an exemplary projectile body 3 which can be coupled to an exemplary projectile payload (e.g., as shown in FIGS. 1-2). Projectile body 3 can be formed with a plurality of slots 51 to allow a payload to lock to projectile body 3 for better flight stability. For example, if slots 51 are configured to receive payload spheres, the spheres will be less likely to shift during projectile flight.

A method of manufacturing projectiles includes providing a projectile body, a projectile base, delay column section, a delay composition, at least one expelling charge, an expelling assembly, and a secondary payload; inserting the expelling assembly into the projectile body; inserting the secondary payload into the projectile body; inserting the at least one expelling charge into the projectile base; inserting the delay composition within the projectile base; coupling the expelling assembly to the projectile base with a first interference fit; and coupling the projectile base to the projectile body with a second interference fit. The first interference fit should be stronger than the second interference fit so that the projectile base can separate from the projectile body during flight a pull the expelling assembly.

Although the invention has been described in detail with reference to certain preferred embodiments, variations and modifications exist within the spirit and scope of the invention as described and defined in the following claims.

The invention claimed is:

1. A projectile comprising:

a projectile body, a projectile base, a delay column section having a first end and a second end, at least one opening in the projectile body for the delay column section, at least one opening in the projectile base for the delay column section, a delay composition, at least one expelling charge, an expelling assembly, and a secondary payload;

wherein, when the projectile is fired, the delay composition burns and ignites the at least one expelling charge;

wherein the at least one expelling charge separates the projectile base from the projectile body and causes the expelling assembly to move towards the first end of the delay column section;

wherein the expelling assembly pushes the secondary payload out the rear of the projectile body.

2. The projectile of claim 1, wherein the secondary payload comprises spheres, flechettes, string/nets, or RFID tags.

3. The projectile of claim 1, wherein the projectile comprises two expelling charges.

4. The projectile of claim 1, wherein a plurality of projectiles are loaded into a magazine or ammunition belt and the delay composition of adjacent projectiles is adjusted to the delay time between firing and payload release to increase the likelihood of hitting a moving target.

5. The projectile of claim 1, wherein the projectile body is coupled to the projectile base with an interference fit.

6. The projectile of claim 1, further comprising a pad disposed between the expelling assembly and the secondary payload.

7. The projectile of claim 1, wherein the delay column section is formed with a necked aperture.

8. The projectile of claim 1, wherein a first end of the expelling assembly is disposed within a frontward portion of the projectile body and a second end of the expelling assembly is coupled to the projectile base.

9. The projectile of claim 1, wherein the secondary payload is disposed radially between the projectile body and the expelling assembly and disposed axially between the expelling assembly and the projectile base.

10. The projectile of claim 1, further comprising a tracer composition disposed within the projectile base.

11. The projectile of claim 1, wherein the delay column section is formed with a restriction orifice.

12. The projectile of claim 1, further comprising a plate disposed between the secondary payload and the at least one expelling charge to prevent the secondary payload from contacting and damaging the delay composition or the least one expelling charge.

13. The projectile of claim 12, wherein the plate is formed with an aperture so that gas from the expelling charge can enter the projectile body.

14. The projectile of claim 12, wherein the plate is formed with a central aperture so that the expelling assembly can pass through the plate.

15. The projectile of claim 1, wherein the projectile body is formed with a plurality of slots to allow the secondary payload to lock to the projectile body for better flight stability.

* * * * *